US008342040B2

(12) United States Patent
Volsin

(10) Patent No.: US 8,342,040 B2
(45) Date of Patent: Jan. 1, 2013

(54) METHOD AND APPARATUS FOR OBTAINING FLUID SAMPLES

(76) Inventor: Kim Volsin, Houma, LA (US)

( * ) Notice: Subject to any disclaimer, the term of this patent is extended or adjusted under 35 U.S.C. 154(b) by 643 days.

(21) Appl. No.: 12/459,803

(22) Filed: Jul. 8, 2009

(65) Prior Publication Data

US 2010/0044037 A1 Feb. 25, 2010

Related U.S. Application Data

(60) Provisional application No. 61/189,637, filed on Aug. 21, 2008.

(51) Int. Cl.
*G01N 1/22* (2006.01)

(52) U.S. Cl. ..... 73/863.21

(58) Field of Classification Search ..... 73/863.21, 73/863.81, 864, 864.91, 863, 152.23; 96/413
See application file for complete search history.

(56) References Cited

U.S. PATENT DOCUMENTS 2,951,368 A * 9/1960 Buchan ..... 73/224

* cited by examiner

*Primary Examiner* — Peter MacChiarolo
*Assistant Examiner* — Tamiko Bellamy
(74) *Attorney, Agent, or Firm* — Ted M. Anthony

(57) ABSTRACT

An apparatus is provided that can be attached to a well to obtain samples of produced liquids. A vessel has an upper port, a lower port and a side port. Produced fluids enter the vessel through the side port. Natural gas associated with the produced fluids exits the vessel through the upper port, and is directed into a vapor recovery or other similar gas handling system and is not permitted to escape into the surrounding environment. Samples of produced liquids (and any accompanying solids) are obtained from the vessel through the lower port.

2 Claims, 3 Drawing Sheets

METHOD AND APPARATUS FOR OBTAINING FLUID SAMPLES

CROSS REFERENCES TO RELATED APPLICATION

Priority of U.S. Provisional patent application Ser. No. 61/189,637 FILED Aug. 21, 2008, incorporated herein by reference, is hereby claimed.

STATEMENTS AS TO THE RIGHTS TO THE INVENTION MADE UNDER FEDERALLY SPONSORED RESEARCH AND DEVELOPMENT

NONE

BACKGROUND OF THE INVENTION

1. Field of the Invention

The present invention pertains to a method and apparatus for obtaining fluid samples from wells and/or other sources capable of producing liquids, such as oil and/or gas wells that produce liquid hydrocarbons.

2. Brief Description of the Prior Art

Testing is performed on oil and/or gas wells for many different reasons. One common type of test that is performed on oil and/or gas wells is known as a production test. By way of illustration, but not limitation, production tests can be performed to evaluate individual well performance, diagnose productivity problems and/or allocate commingled production between individual wells.

When a production test is being performed, a well is typically permitted to produce for a fixed period of time. Variables are observed and measured while the well is producing including, but not necessarily limited to, production rates (for gas, oil and/or water), the well's flowing tubing pressure and choke size.

It is also frequently beneficial to obtain at least one sample of any liquids produced from a well, especially during the production testing process. Depending on a particular well's producing characteristics, a sample may include oil, condensate and/or other liquid hydrocarbons. Additionally, most production samples will also typically include basic sediment and water ("BS&W"). BS&W content generally includes free water, sediment and emulsion, and is measured as a volume percentage of the overall production stream.

In some circumstances, water production from certain wells is not separately metered, so water production rates must be determined using percentages derived from BS& W testing. Additionally, BS&W testing can also help to determine whether formation sand is being produced from a well. This information can be critically important because such formation sand can negatively impact the productive capacity of a well. Further, over time, such sand production can also cause problems with flow lines and surface production facilities (such as, for example, separators and other vessels), because such sand can accumulate and fill the vessels and/or cause erosion problems in the vessels and/or associated flow lines.

Currently, liquid samples are typically obtained by personnel directly from flow lines exiting wells (usually from a ½-inch "needle valve" installed on a flow line). In most cases, a liquid sample is released directly from an outlet point on a flow line into an open container such as a graduated cylinder or the like. The liquid sample is then placed in a centrifuge, and the sample is rotated so that entrained gas in the sample can be released and the constituent components of the sample can be separated from each other. Samples are also frequently taken at the inlet of production separators or other similar vessels for comparison purposes.

The current means of obtaining produced liquid samples suffers from a number of very significant limitations including, but not necessarily limited to, safety and environmental limitations. Specifically, personnel obtaining such samples are frequently directly exposed to potentially toxic gases (typically gases associated with oil or other liquid hydrocarbons produced with the sample) while such samples are being taken. Further, such produced gases are typically released directly into the surrounding environment during the sampling process; such released gases can negatively impact the environment, and represent lost revenue that could otherwise be captured if such gases had not been released.

Frequently, entrained gases must also be permitted to settle out of production samples obtained from flow lines using existing sampling methods. As a result, the sampling process often must be repeated multiple times in order to accumulate sufficient volumes of produced liquids. When the sampling process is repeated, the negative impact associated with such sampling process is likewise repeated.

SUMMARY OF THE PRESENT INVENTION

The method and apparatus of the present invention permits acquisition of produced liquid samples from oil and/or gas wells, while reducing the amount of toxic gases released into the surrounding environment during the sampling process by routing such gases directly back into a well's gas recovery system. Because such gases are not released into the surrounding environment, personnel obtaining samples are not directly exposed to such toxic or harmful gases. Further, the present invention provides an economical and environmentally safe means for capturing revenue that would otherwise be lost due to gases escaping into the atmosphere during the sampling process. Moreover, by eliminating the need for time-consuming multiple sampling operations to allow gas to settle out in order to obtain the desired volume of liquids, the present invention also reduces labor requirements, thereby freeing up personnel to address other tasks.

In the preferred embodiment, the present invention comprises a substantially hollow vessel having an inner chamber. Although the specific size, configuration and orientation of said vessel can vary, in the preferred embodiment said vessel comprises a substantially cylindrical elongate body section a few inches in diameter, and approximately 10 to 13 inches in length.

A plurality of ports extends through said vessel, thereby permitting access into the inner chamber of said vessel. In the preferred embodiment, said vessel is oriented substantially vertically; at least one port is situated at or near the upper end of said vessel, while at least one port is situated at or near the lower end of said vessel. At least one port is also situated in the side of said vessel along the length of said vessel. In the preferred embodiment, a valve (such as a needle valve or the like) is connected to each port to control flow in and out of said vessel through such ports.

In its basic configuration, the present invention further comprises a first conduit extending from a desired sample point associated with a well to a port extending through the side of the vessel. By way of illustration, but not limitation, such sample point is typically located at a convenient place along the production flow line of a well; however, it is to be observed that said sample point can be located at any number of other different locations downstream of a well. Although said first conduit can be constructed from many different types of pipe or tubing, in the preferred embodiment, said first conduit is constructed from ½" or ¼" stainless steel tubing.

A second conduit extends from said first conduit to a vapor recovery system or other similar gas gathering system. Although said second conduit can be constructed from many different types of pipe or tubing, in the preferred embodiment, said second conduit is constructed from ½" or ¼" stainless steel tubing.

A third conduit extends from a port at or near the upper end of said vessel to said vapor recovery system or other similar gas gathering system used to collect and process gas production from the subject well and/or other wells in the vicinity. Although said third conduit can be constructed from many different types of pipe or tubing, in the preferred embodiment, said third conduit is also constructed from ½" or ¼" stainless steel tubing. In the preferred embodiment, a check valve is also installed on said third conduit near the upper end of said vessel; the check valve permits fluid to exit the vessel through said third conduit, but prevents fluid from entering the vessel from the third conduit.

When obtaining of a sample from a well is desired, the vessel of the present invention, as well as connecting conduits, are purged with production from the well. Thereafter, produced fluids are permitted to flow into the vessel. After a period time, fluid flow from the well to the vessel is interrupted; liquids are permitted to remain in the vessel, while associated gas production flows from the port at or near the top of the vessel into the vapor recovery system or other similar gas gathering system. A sample of produced liquids can then be obtained from the port at or near the base of the vessel by permitting produced liquids to drain out of said lower port.

The present invention permits produced liquid samples to be recovered from wells without directly exposing personnel to natural gas and/or toxic components thereof. Because all such natural gas is directed to a well's vapor recovery or other gas collection system, natural gas does not escape and contaminate the surrounding environment. Further, such gas is collected and can be sold, thereby capturing revenue that would otherwise be lost without the benefits provided by the present invention.

BRIEF DESCRIPTION OF THE DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed.

DETAILED DESCRIPTION OF A PREFERRED EMBODIMENT OF THE INVENTION

Figure 1:
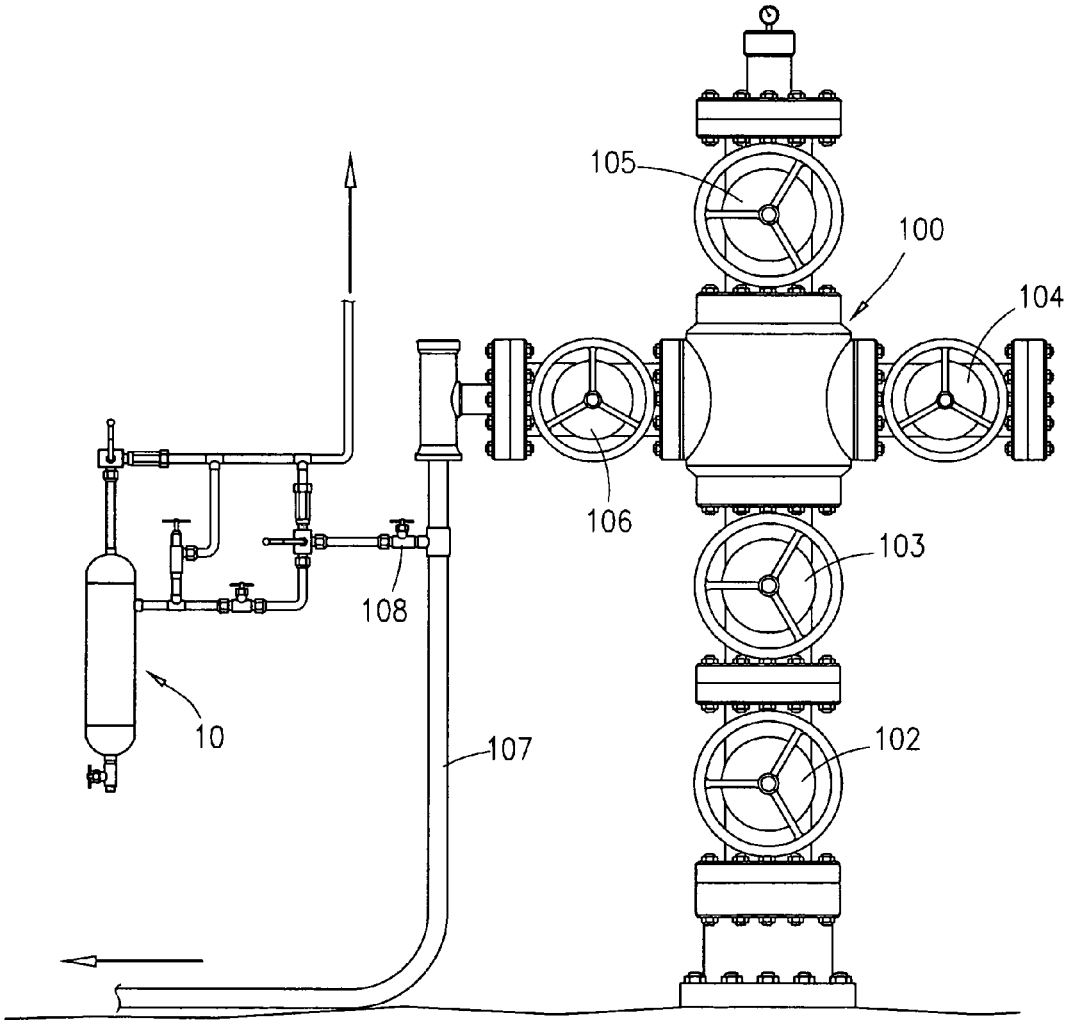
FIG. 1 depicts a side view of the testing apparatus of the present invention installed on a well.

FIG. 1 depicts a side view of testing apparatus 10 installed on oil well 100 having sub-surface components extending into the earth's crust (not depicted in FIG. 1). In FIG. 1, the surface component of said oil well 100 comprises a combination of valves 102, 103, 104 and 105 and other components configured in a manner known to those having skill in the art, and commonly referred to as a "Christmas tree". Wing valve 106 is connected to said oil well 100, while flow line 107 extends from said wing valve 106. Production flowing out of well 100, which typically consists of some combination of liquid hydrocarbons (such as oil or condensate), natural gas and/or produced water, passes from tree 100, through wing valve 106, and into flow line 107. Such production is thereafter transported through flow line 107 to production facilities or other downstream equipment for separation and/or other treatment prior to sale or other ultimate disposition.

Testing assembly 10 of the present invention, as depicted in FIG. 1, is attached to flow line 107, which typically represents a convenient location for installation of said testing assembly 10. However, it is to be understood that the specific location of testing assembly 10 depicted in FIG. 1 is for illustration purposes only, and is not intended to be limiting in any way; as such, testing assembly 10 of the present invention can be installed at many different locations in the general vicinity of well 100 (including, without limitation, on downstream equipment such as production separators and the like) without detracting from the benefits provided by the present invention.

Figure 2:
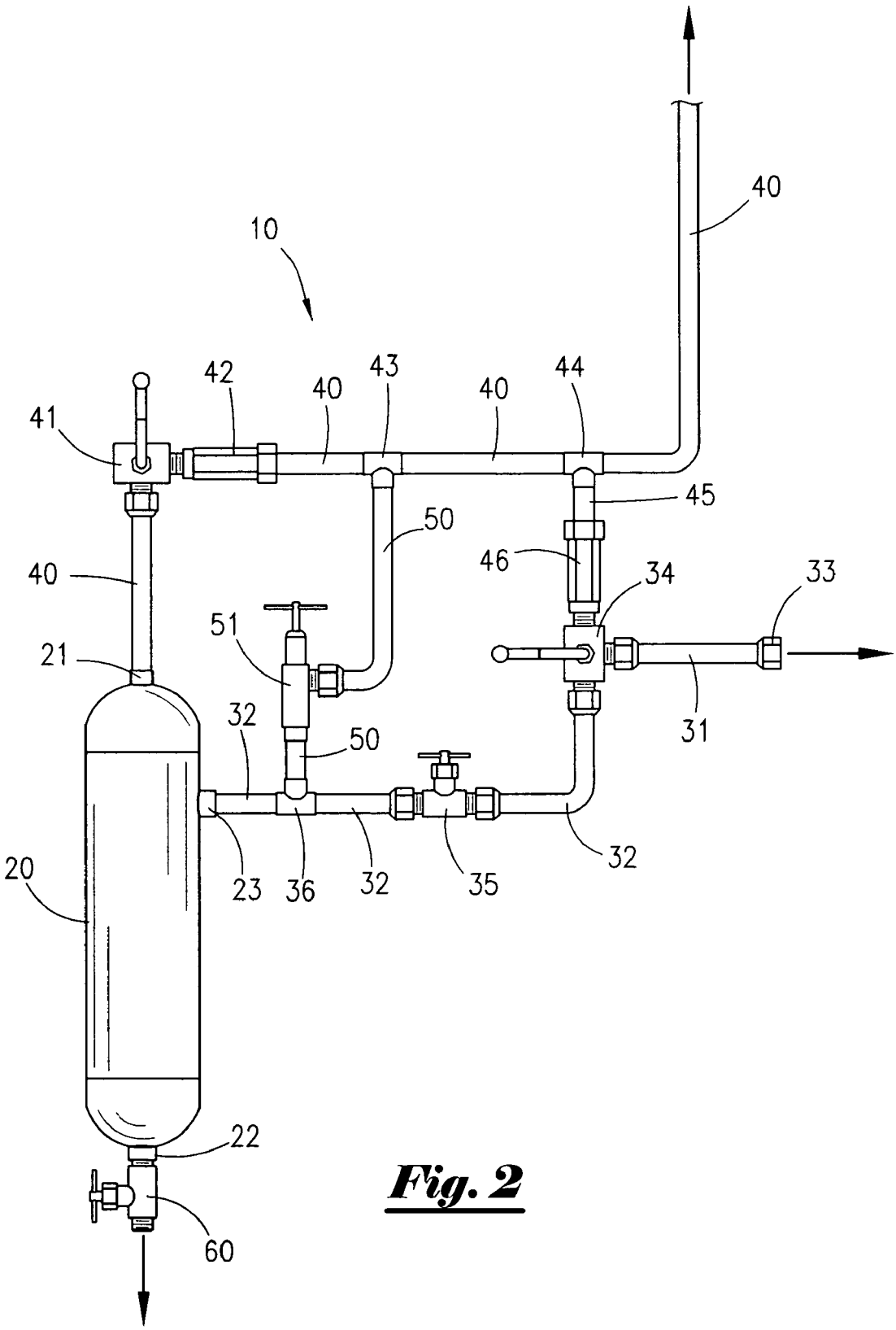
FIG. 2 depicts a side view of the testing apparatus of the present invention.

FIG. 2 depicts a detailed side view of testing assembly 10 of the present invention. In the preferred embodiment, testing assembly 10 comprises a substantially hollow vessel 20 defining an inner chamber. Although the specific size and configuration of said vessel 20 can vary, in the preferred embodiment said vessel 20 comprises an elongate and substantially cylindrical body section approximately 3 inches in diameter, and approximately 10 to 13 inches in length. In the preferred embodiment, vessel 20 is mounted in a substantially vertical orientation.

Although not visible in FIG. 2, a plurality of ports extends through vessel 20. Such ports permit access into the inner chamber of said vessel 20. In the preferred embodiment, at least one port is situated at or near the upper end of said vessel 20, while at least one port is situated at or near the lower end of said vessel 20. At least one port is also situated in the side of said vessel 20 along the length of said vessel 20.

In the preferred embodiment, coupling 21 is connected to said vessel 20 at said port located at or near the upper surface of said vessel 20. Similarly, coupling 22 is connected to said vessel 20 at said port situated at or near the bottom surface of said vessel 20. Coupling 23 is connected to said vessel 20 via said port situated in the side of said vessel 20. Couplings 21, 22 and 23 permit the connection of other components (such as valves or conduits) that are in fluid communication with the inner chamber of vessel 20.

Still referring to FIG. 2, sample conduit 31 extends from a desired sample point downstream from a well (such as a sample point on flow line 107 connected to needle valve 108 depicted in FIG. 1). By way of illustration, but not limitation, such sample point should be beneficially located at a convenient place along the production flow line of a well; however, it is to be observed that said sample point can be located at any number of other locations downstream of a well. Although said sample conduit 31 can be constructed from many different types of pipe or tubing, in the preferred embodiment, said sample conduit is constructed from ½" or ¼" stainless steel tubing. In the preferred embodiment of the present invention, connection coupling 33 is provided on one end of sample conduit 31 for attachment to, and fluid communication with, a needle valve or other outlet port associated with a sample point for a well (such as, for example, needle valve 108 depicted in FIG. 1). In the preferred embodiment, sample conduit 31 is connected to an inlet of three-way valve 34 using a coupling or other connection means. As depicted in FIG. 2, three-way valve 34 has at least two outlet ports.

Supply conduit 32 extends from an outlet of three-way valve 34, and generally extends to coupling 23 on the side of vessel 20. Although said supply conduit 32 can be constructed from many different types of pipe or tubing, in the preferred embodiment, said supply conduit 32 is constructed from ½" or ¼" stainless steel tubing. In the preferred embodiment, needle valve 35 is installed along supply conduit 32 to selectively block or interrupt fluid flow through supply conduit 32. Similarly, in the preferred embodiment, tap 36 (which is described in detail below) is also provided along supply conduit 32.

Outlet conduit 40 is connected to coupling 21 at or near the upper surface of vessel 20, and is in fluid communication with the inner chamber of vessel 20. In the preferred embodiment, said outlet conduit 40 generally extends to a vapor recovery system or other similar gas gathering system (not shown in FIG. 2) capable of receiving and handling natural gas (and typically some minimal liquid) production. Although outlet conduit 40 can be constructed from many different types of pipe or tubing, in the preferred embodiment, said outlet conduit 40 is constructed from ½" or ¼" stainless steel tubing. Further, in the preferred embodiment, a valve such as valve 41 is installed within outlet conduit 40 to selectively block or interrupt fluid flow passing through said outlet conduit 40. In the preferred embodiment, valve 41 can also provide an inlet to permit the introduction of mineral spirits or other desired cleaning agent into vessel 20 and related equipment. Additionally, check valve 42 is also installed on said outlet conduit 40; check valve 42 permits fluid to exit vessel 20 through said outlet conduit 40, but prevents fluid from entering vessel 20 via said outlet conduit 40. Similarly, in the preferred embodiment, tap 43 (which is described in detail below) is also provided along outlet conduit 40.

In the preferred embodiment of the present invention, tap 36 is provided in supply conduit 32, while tap 43 is provided in outlet conduit 40. Bypass conduit 50 generally extends from tap 36 to tap 43, and permits fluid communication between supply conduit 32 and outlet conduit 40. Further, in the preferred embodiment, a valve such as needle valve 51 is installed within bypass conduit 50 between taps 36 and 43 to selectively block or interrupt fluid flow passing through bypass conduit 50.

Still referring to FIG. 2, tap 44 is also provided on outlet conduit 40. Purge conduit 45 extends from an outlet port of three-way valve 34 to tap 44 in outlet conduit 40. In the preferred embodiment, check valve 46 is also installed on said purge conduit 45; check valve 46 permits fluid to flow through three-way valve into conduit 45 (and, eventually, into outlet conduit 40), but prevents fluid from entering three-way valve 34 via said purge conduit 45.

When a produced liquid sample from a well is desired, vessel 20 of the present invention (and a portion of outlet conduit 40, if desired) is first purged with produced fluids from said well. Specifically, needle valve 108 (depicted in FIG. 1) is opened. Three-way valve 34 is opened so that produced fluids will flow through sample conduit 31, three-way valve 34, supply conduit 32, valve 35 (when open), past tap 36 (with valve 51 closed) and into vessel 20; said fluids are permitted to pass through vessel 20 to a vapor recovery system via outlet conduit 40. After a period time, flow of produced fluids from the well to vessel 20 is stopped by closing three-way valve 34 or needle valve 35. Liquids (and any suspended or accompanying solids) will remain within the inner chamber of vessel 20, while gas is permitted to escape from the inner chamber of said vessel 20 via outlet conduit 40 (with valve 41 open).

Said gas is directed into a vapor recovery system or other similar gas gathering system. In this manner, any natural gas associated with such sample is captured for subsequent sale or injection, and is not released into the surrounding environment. Thereafter, a sample of produced liquids (together with any suspended or accompanying solids) can then be permitted to drain out of the inner chamber of vessel 20 through valve 60, and into a graduated cylinder or other receptacle.

Figure 3:
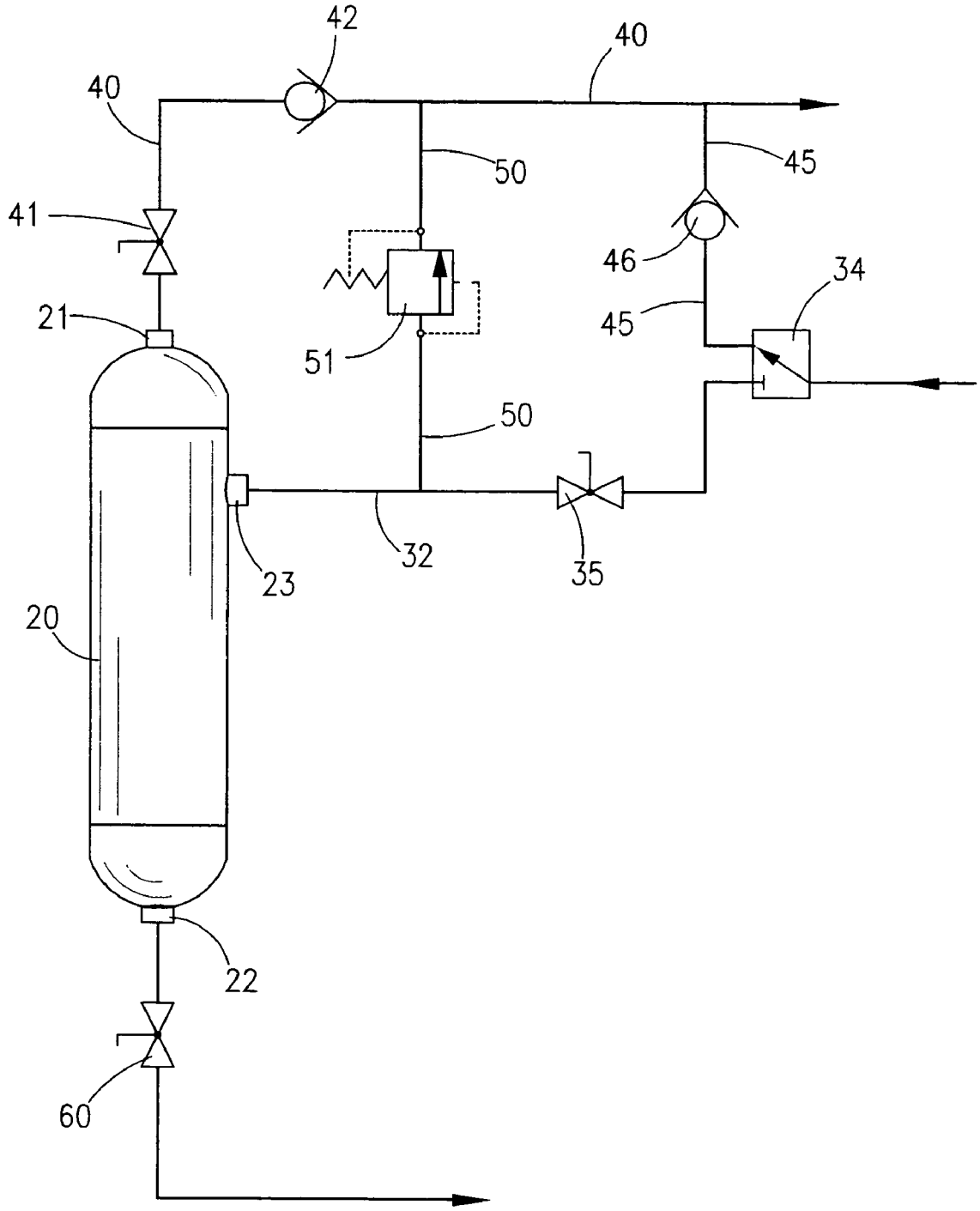
FIG. 3 depicts a flow schematic depicting fluid flow in connection with the testing apparatus of the present invention.

FIG. 3 depicts a schematic representation of the apparatus of the present invention depicted in FIG. 2. Reference numerals for components of the schematic representation depicted in FIG. 3 represent like components depicted in FIG. 2.

Referring to FIG. 3, a sample of produced liquids (together with accompanying or suspended solids) can be obtained using the following basic procedure:

1. If line purging is desired, a valve from a well flow line (such as valve 108 in FIG. 1) is opened.
2. Three-way valve 34 is opened to permit produced fluids to flow through said valve 34, (optional check valve 46) and conduit 45 to the vapor recovery system to purge piping/conduits leading to vapor recovery system (time of purge will vary according to distance between flow line and sample point).
3. After line purging is completed, three-way valve 34 is closed.
4. Valves 41 and 35 are then opened.
5. Three-way valve 34 is then opened to permit produced fluids to flow from the well's flow line through three-way valve 34, conduit 32, valve 35 into vessel 20, and thereafter to the vapor recovery system via conduit 40. In the preferred embodiment, produced well fluids are permitted to flow through the testing apparatus of the present invention for approximately one minute in order to purge vessel 20 and related equipment.
6. Three-way valve 34 is then closed, interrupting flow of produced fluids into vessel 20, and gas is permitted to bleed off out of vessel 20 via outlet conduit 40.
7. Thereafter, a sample of produced liquids (together with any suspended or accompanying solids) remaining in vessel 20 can be permitted to drain from vessel 20 through valve 60 and into a graduated cylinder or other receptacle.
8. After desired samples have been obtained, mineral spirits or other substance can be introduced into vessel 20 via valve 41 to flush said vessel.

The method and apparatus of the present invention allows for the acquisition of produced liquid samples while preventing release of toxic gases into the surrounding environment during the sampling process by directing such gases back into a well's gas recovery system. Because gases from the sample are not released into the environment, personnel obtaining such samples are not directly exposed to such gases. Further, the present invention provides an economical and environmentally safe means for capturing revenue that would otherwise be lost due to gases escaping into the atmosphere during the sampling process. By eliminating the need for multiple sampling iterations to allow gas to settle out, the present invention also reduces labor requirements, thereby freeing up personnel to work on other matters.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A method for obtaining liquid samples from a well comprising the steps of:

a. temporarily diverting the flow of well fluids comprising liquid and gas components from a production flow path into a vessel having a top, a bottom, a length, and an inner chamber, wherein said inner chamber of said vessel defines a volume substantially equal to the volume of a sample to be obtained, a plurality of ports extend through said vessel into said inner chamber, at least one of said ports is located at or near the top of said vessel, and at least one of said ports is located at or near the bottom of said vessel;

b. substantially filling said inner chamber of said vessel with well fluids;

c. interrupting the flow of well fluids into said vessel;

d. releasing gas from the inner chamber of said vessel to a vapor recovery system;

e. opening said at least one port at or near the bottom of the vessel; and f. draining liquids from said vessel into a receptacle at ambient pressure.

2. The method of claim 1, wherein said receptacle is a graduated cylinder.

* * * * *